United States Patent [19]

Yamato et al.

[11] Patent Number: 4,844,038

[45] Date of Patent: Jul. 4, 1989

[54] ABNORMALITY DETECTING METHOD FOR EXHAUST GAS CONCENTRATION SENSOR FOR INTERNAL COMBUSTION ENGINES

[75] Inventors: Akihiro Yamato; Masahiko Yakuwa, both of Wako, Japan

[73] Assignee: Honda Giken Kogyo Kabushiki Kaisha, Tokyo, Japan

[21] Appl. No.: 946,741

[22] Filed: Dec. 24, 1986

[30] Foreign Application Priority Data

Dec. 25, 1985 [JP] Japan ..... 60-297819

[51] Int. Cl.[4] ..... F02D 41/22

[52] U.S. Cl. ..... 123/479; 123/489

[58] Field of Search ..... 123/440, 489, 479, 589; 60/276; 73/23

[56] References Cited

U.S. PATENT DOCUMENTS 4,359,030 11/1982 Sone et al. ..... 123/440
4,485,786 12/1984 Kashimura ..... 123/489
4,502,443 3/1985 Hasegawa et al. ..... 123/489

FOREIGN PATENT DOCUMENTS 58-70036 4/1983 Japan ..... 123/440
58-143145 8/1983 Japan ..... 123/440
59-96451 6/1984 Japan ..... 123/489

*Primary Examiner*—Andrew M. Dolinar
*Attorney, Agent, or Firm*—Lyon & Lyon

[57] ABSTRACT

A method of detecting abnormality in an exhaust gas concentration sensor in an internal combustion engine equipped with a fuel supply control system which controls a quantity of fuel to be supplied to the engine in a feedback manner responsive to a value of an air-fuel ratio correction value set in response to an output signal from the sensor. The sensor output signal is monitored from the time a first predetermined period of time has elongated from the start of the engine. The sensor is diagnosed as abnormal if the output signal has continually maintained a substantially constant value over a second predetermined time period elapsed following the first predetermined time period. The first predetermined time period corresponds to a time lag in rise of the output signal. The second predetermined time period is set such that the sum of the first and second preetermined time periods is shorter than a period of time within which the sensor becomes completely activated after the start of the engine.

7 Claims, 5 Drawing Sheets

| FIG. 3A |
| --- |
| FIG. 3B |

ABNORMALITY DETECTING METHOD FOR EXHAUST GAS CONCENTRATION SENSOR FOR INTERNAL COMBUSTION ENGINES

BACKGROUND OF THE INVENTION

This invention relates to a method of detecting abnormality in an exhaust gas concentration sensor for use in an internal combustion engine equipped with a fuel supply control system, which controls the air-fuel ratio of a mixture to be supplied to the engine in a feedback manner responsive to an output from the sensor.

It has conventionally been carried out to detect the concentration of a specific component, e.g. oxygen contained in exhaust gases emitted from an internal combustion engine, and set the value of an air-fuel ratio correction coefficient in response to the detected concentration value, and correct a basic fuel supply quantity by the set correction coefficient to thereby control the air-fuel ratio of an air-fuel mixture being supplied to the engine so that it is maintained within a certain range with a desired air-fuel ratio value as the median value. As such a sensor for detecting the oxygen concentration an oxygen concentration sensor (hereinafter called "$O_2$ sensor") has generally been employed, which is formed of a solid electrolyte of zirconia ($ZrO_2$) for example. This typ $O_2$ sensor has such a characteristic that its electromotive force suddenly changes as the air-fuel ratio of a mixture supplied to the engine varies across a stoichiometric mixture ratio in such a manner that the sensor output voltage assumes a higher level and a lower level than a predetermined reference output voltage, respectively, when the air-fuel ratio is richer than the stoichiometric mixture ratio and when the former is leaner than the latter. Electric disconnection in the $O_2$ sensor of this type or in the wiring thereof or deterioration of the sensor exerts a great influence upon the accuracy of the air-fuel ratio control. Therefore, it is necessary to always monitor the operation of an exhaust gas component concentration detection system including the $O_2$ sensor so as to ensure normal functioning of the air-fuel ratio control system based upon a normal output from the sensor.

Various methods for detecting abnormality in such exhaust gas concentration sensors have heretofore been proposed. For example, a method has been proposed by Japanese Provisional Patent Publication (Kokai) No. 58-222939, which measures the interval of time from an instant the value of an air-fuel ratio correction coefficient changes stepwise to an instant it again changes stepwise, i.e. the time interval from the time the sensor output is inverted from a rich side to a lean side or vice versa with respect to a predetermined reference level, decides that the sensor is faulty if the measured time interval is longer than a predetermined period of time, and then sets the air-fuel ratio correction coefficient value to a predetermined value and corrects a basic fuel supply quantity by the set coefficient value.

Another abnormality detection method has been proposed by Japanese Provisional Patent Publication (Kokai) No. 59-3137, which determines whether the value of an air-fuel correction coefficient falls outside a normal range defined by upper and lower limit values that can be assumed by an exhaust gas concentration sensor during operation of an internal combustion engine functioning normally, and when the coefficient value falls outside the normal range, measures the time elapsed from the time the coefficient value shows a value outside the normal range for the first time, and decides that the sensor is malfunctioning if the measured elapsed time exceeds a predetermined time period.

These conventionally proposed methods have the disadvantage that when the engine is operating in a low load condition such as an idling condition, the temperature of an $O_2$ sensor applied is so low that the sensor has not been activated as yet with its output level being uncertain or unstable, sometimes outputting a rich or lean value which does not correctly represent the actual air-fuel value, resulting in failure of accurate air-fuel ratio control, and if the abormality detection is carried out when the sensor output is still uncertain or unstable, it can result in a wrong diagnosis that the sensor is functioning abnormally even if it is actually operating normally. Therefore, these conventional methods cannot be carried out before the $O_2$ sensor is completely activated, and as a result, the time period before abnormality of the sensor can be accurately detected after the start of the engine is considerably long, which can cause degraded exhaust emissions from the engine due to the failure of the sensor to properly function.

An abnormality detection method is also known from Japanese Provisional Patent Publication (Kokai) No. 53-95431, which decides that an exhaust gas concentration sensor such as an $O_2$ sensor is faulty if the output voltage from the sensor assumes a very high value, e.g. 6 volts. According to this method, although a disconnection in the sensor or in the wiring can be correctly detected, a short-circuit in the sensor or in the wiring cannot be detected because the output voltage should then drop to 0 volt.

OBJECT AND SUMMARY OF THE INVENTION

It is therefore the object of the invention to provide an abnormality detection method for an exhaust gas concentration sensor such as an $O_2$ sensor for use in an internal combustion engine equipped with a fuel supply control system, which is capable of detecting abnormality in the sensor at an early time after the start of the engine and without fail.

The present invention provides a method of detecting abnormality in an exhaust gas concentration sensor for detecting the concentration of a component in exhaust gases from an internal combustion engine equipped with a fuel supply control system which controls a quantity of fuel to be supplied to the engine in a feedback manner responsive to a value of an air-fuel ratio correction value set in response to an output signal from the exhaust gas concentration sensor.

The method according to the invention is characterized by comprising the following steps:

(a) monitoring the output signal from the exhaust gas concentration sensor from the time a first predetermined period of time has elapsed from the start of the engine;

(b) determining whether or not the output signal has continually maintained a substantially constant value for a second predetermined period of time elapsed following the first predetermined period of time; and (c) rendering a decision that the exhaust gas concentration sensor is functioning abnormally if the output signal has continually maintained a substantially constant value over the second predetermined period of time.

Preferably, the first predetermined period of time is set at a value corresponding to a time lag in rise of the output signal from the exhaust gas concentration sensor.

Also preferably, the second predetermined period of time is set at such a value that the sum of the first predetermined period of time and the second predetermined period of time is shorter than a period of time within which the exhaust gas concentration sensor becomes completely activated after the start of the engine.

The above and other objects, features and advantages of the invention will be more apparent from the ensuing detailed description taken in conjuction with the accompanying drawings.

DETAILED DESCRIPTION

The method of the invention will now be described in detail with reference to the drawings showing an embodiment thereof.

Figure 1:
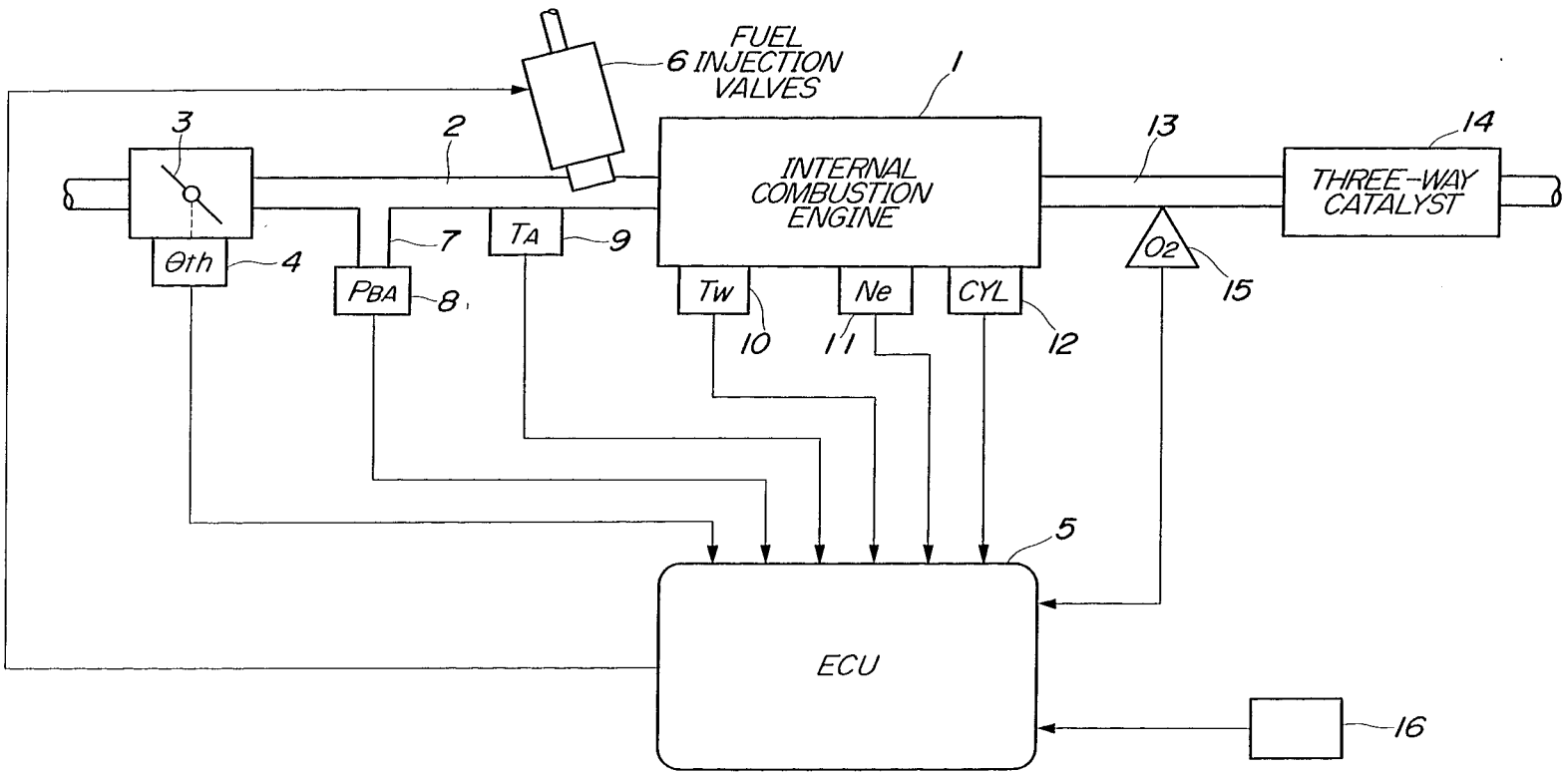
FIG. 1 is a block diagram showing the whole arrangement of a fuel supply control system for an internal combustion engine, to which is applied the method of the invention.

Referring first to FIG. 1, there is illustrated the whole arrangement of an internal combustion engine equipped with a fuel supply control system, to which is applied the method of the invention. In the figure, reference numeral 1 designates an internal combustion engine which may be a four-cylinder type, for instance. An intake pipe 2 is connected to the cylinder block of the engine at an intake side thereof. A throttle valve 3 is arranged within the intake pipe 2, to which is connected a throttle valve opening ($\theta$th) sensor 4, which detects the throttle valve opening Oth by converting same into an electric signal and supplies the electric signal to an electronic control unit (hereinafter called "the ECU") 5.

Fuel injection valves 6, each provided for each of the engine cylinders, are arranged in the intake pipe 2 at locations between the engine 1 and the throttle valve 3, slightly upstream of respective intake valves, not shown, of respective cylinders. Each of the fuel injection valves 6 are connected to a fuel pump, not shown, and also electrically connected to the ECU 5 to have it valve opening period controlled by a valve-opening driving signal from the ECU 5.

On the other hand, an absolute pressure (PBA) sensor 8 is connected to the intake pipe 2 via a pipe 7 at a location immediately downstream of the throttle valve 3, which senses the absolute pressure PBA by converting same into an electric signal and supplies the electric signal to the ECU 6. An intake air temperature (TA) sensor 9 is inserted into the intake pipe 2, at a location downstream of the absolute pressure sensor 8, for sensing the temperature of intake air being drawn into the engine 1, an output signal of which is supplied to the ECU 5.

Mounted on the cylinder block of the engine 1 is an engine coolant temperature (TW) sensor 10 which is embedded in a peripheral wall of a cylinder filled with coolant and senses the engine coolant temperature TW as a temperature representative of the engine temperature and supplies an electrically converted signal to the ECU 5.

An engine rotational speed (Ne) sensor 11 and a cylinder-discriminating (CYL) sensor 12 are arranged in facing relation to a camshaft of the engine or a crankshaft of same, neither of which is shown. The sensor 11 is adapted to generate a pulse of a crank angle position signal as a top-dead-center (TDC) signal at one of predetermined crank angles each in advance of the top dead center position at the start of suction stroke of each cylinder each time the crankshaft of the engine rotates through 180 degrees. The sensor 12 is adapted to generate a pulse as a cylinder-discriminating signal at a predetermined crank angle of the crankshaft corresponding to a particular one of the engine cylinders, i.e. each time the crankshaft rotates through 720 degrees. Output pulses from the sensors 11 and 12 are supplied to the ECU 5.

An exhaust pipe 13 is connected to the cylinder block of the engine 1 at an exhaust side thereof, in which is arranged a three-way catalyst 14 for purifying exhaust gas components, i.e. HC, CO, and NOx. Inserted into the exhaust pipe at a location upstream of the three-way catalyst 14 is an $O_2$ sensor 15 for sensing the concentration of oxygen in the exhaust gases, an output signal of which is supplied to the ECU 5.

Further connected to the ECU 5 are other engine operating parameter sensors 16 including an atmospheric pressure sensor, which supply signals indicatives of the respective detected engine operating parameter values, to the ECU 5.

The ECU 5 calculates the valve opening period (fuel injection period) TOUT for the fuel injection valves 6, based upon the input signals from the various engine operating parameter sensors described above and in synchronism with inputting of the TDC signal thereto, by the use of the following equation:

$$TOUT = Ti \times KO_2 \times K1 \times K2$$

where Ti is a basic value of the valve opening period for the fuel injection valves, which is determined as a function of the engine rotational speed Ne and intake pipe absolute pressure PBA sensed, respectively, by the Ne sensor 11 and the intake pipe absolute pressure sensor 8. $KO_2$ is an air-fuel ratio correction coefficient whose value is determined in response to the concentration of oxygen sensed by the $O_2$ sensor 15 during feedback control operation of the air-fuel ratio executed when the engine is in a predetermined feedback control-effecting region, while it is set to and held at a mean value KREF of values of the air-fuel correction coefficient $KO_2$ obtained during past feedback control operation during open loop control of the air-fuel ratio executed when the engine is operating in any of particular operating conditions other than the feedback control-effecting region, such as a wide-open-throttle region and a decelerating region. K1 and K2 are correction coefficients and correction variables, respectively, which are calculated based upon output signals indicative of sensed engine operating parameters from various sensors as referred to previously, i.e. the throttle valve opening sensor 4, the intake pipe absolute pressure sensor 8, the intake air temperature sensor 9, the engine coolant temperature sensor 10, the cylinder-discriminating sensor 12, the $O_2$ sensor 15, and the other parameter sensors 16. The values of these coefficients and variables K1, K2 are set by means of respective equations, tables or the like in response to operating conditions of the engine 1 to such values as optimize various characteristics of the engine such as startability, exhaust emission characteristics, fuel consumption, and accelerability.

The ECU 5 further operates to supply the fuel injection valves 6 with driving signals corresponding to the valve opening period TOUT determined as above, during operation of the engine, to open same over the time period TOUT.

Figure 2:
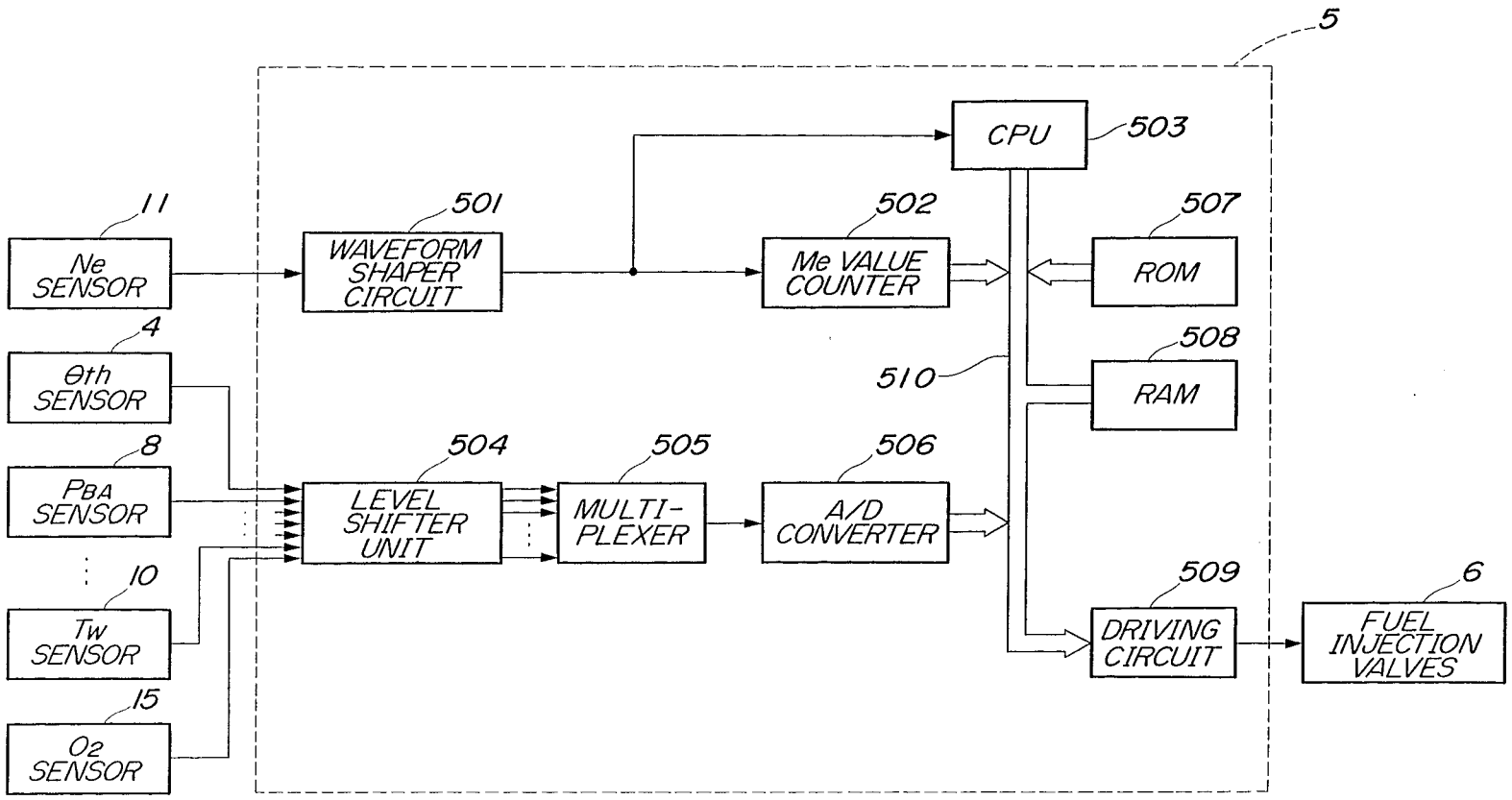
FIG. 2 is a block diagram showing the interior construction of an electronic control unit (ECU) appearing in FIG. 1.

FIG. 2 shows the interior construction of the ECU 5 referred to above. An engine rotational speed signal from the Ne sensor 11 in FIG. 1 has its pulse waveform shaped by a waveform shaper circuit 501, and supplied to a central processing unit (hereinafter called "the CPU") 503 as well as to an Me value counter 502 as the TDC signal. The Me value counter 502 counts or measures the time interval between generation of an immediately preceding pulse of the TDC signal and a present one, and the resulting measured value Me is proportional to the reciprocal of the engine rotational speed Ne. The Me value counter 502 supplies the counted Me value to the CPU 503 via a data bus 510.

Analog output signals from the throttle valve opening sensor 4, the intake pipe absolute pressure sensor 8, the engine coolant temperature sensor 10, the $O_2$ sensor 15, etc. in FIG. 1 are shifted in level to a predetermined level by means of a level shifter unit 504 and the level-shifted signals are successively delivered to an analog-to-digital (A/D) converter 506 by means of a multiplexer 505 to be successively converted thereby into respective corresponding digital signals. The digital signals are then supplied to the CPU 503 via the data bus 510.

Connected to the CPU 503 via the above data bus 510 are a read-only memory (ROM) 507, a random access memory (RAM) 508, and a driving circuit 509. The ROM 507 stores various programs executed within the CPU 503, such as a program for calculating the valve opening period TOUT of the fuel injection valves 6 and a program for detecting abnormality in the $O_2$ sensor, hereinafter described with reference to FIG. 3, various maps or tables for the basic fuel injection period Ti, as well as various predetermined values such as $VO_2$, referred to later, etc. The RAM 508 temporarily stores results of various calculations executed within the CPU 503, data read in from the Me value counter 502 and the A/D converter, etc. The driving circuit 509 receives data of the valve opening period TOUT from the CPU 503 and supplies driving signals to the fuel injection valves 6 to open them over the time period TOUT.

Figure 4:
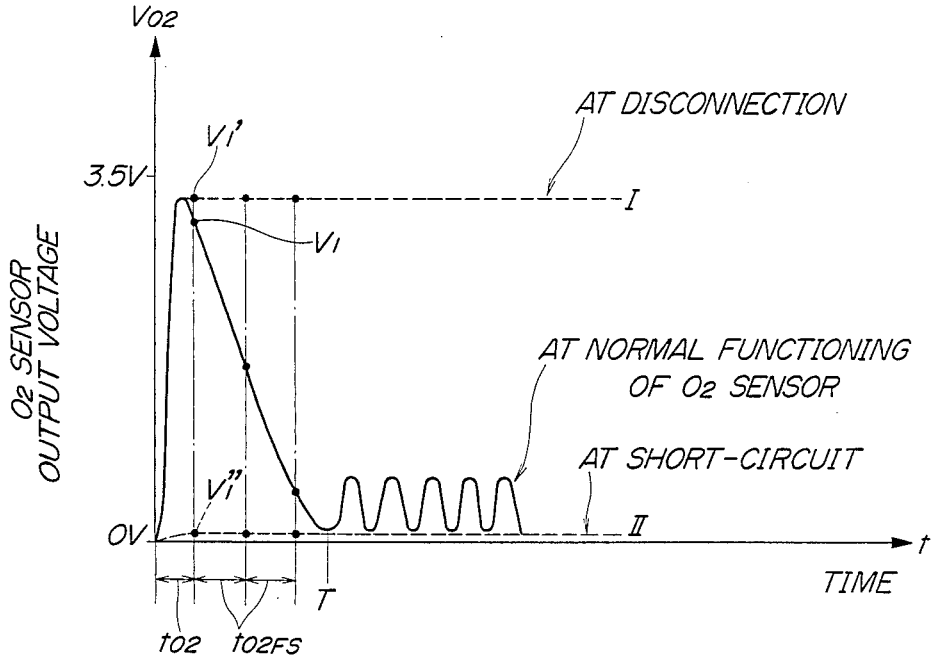
FIG. 4 is a graph showing output characteristics of the $O_2$ sensor, given by way of example.
Figure 5:
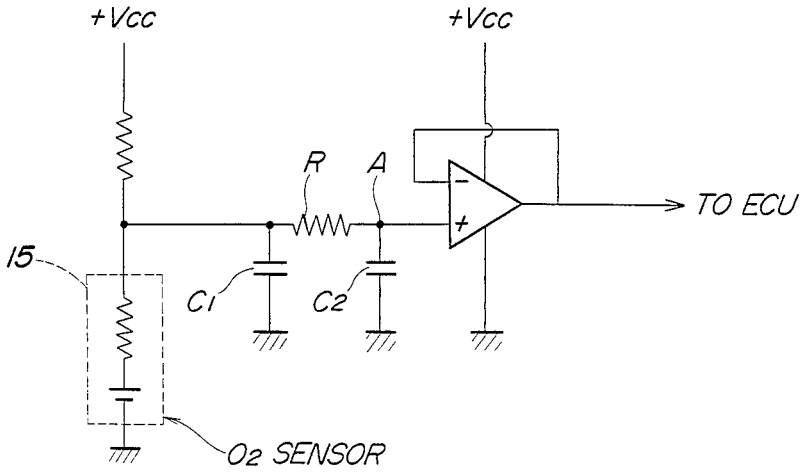
FIG. 5 is a circuit diagram showing an input circuit for processing an output signal from the $O_2$ sensor.

FIG. 4 shows, by way of example, characteristics of output voltage supplied from the $O_2$ sensor 15 after closing of the ignition switch of the engine, and FIG. 5 shows an input circuit interposed between the $O_2$ sensor 15 and the ECU 5 for processing output from the $O_2$ sensor 15. As will be noted from the graph of FIG. 4, the output voltage $VO_2$ from the $O_2$ sensor 15 at a point A in FIG. 5 rises from 0 volt to approximately 3.5 volts, upon closing of the ignition switch, with a time lag corresponding to the time constant of capacitors $C_1$ and $C_2$ and a resistance R forming a low pass filter in the input circuit of FIG. 5. Then, the output voltage $VO_2$ gradually decays as the activation of the $O_2$ sensor 15 proceeds, and reaches nearly 0 volt when the activation has been completed (at point T in FIG. 4). hereafter, if the $O_2$ sensor is functioning normally, the output voltage $VO_2$ will become high in level (0.9 volts) as the oxygen concentration in the exhaust gases becomes rich, and low in level (0.1 volt) as the oxygen concentration becomes lean. If there occurs a disconnection in the $O_2$ sensor itself or in the wiring, the output voltage $VO_2$ should continually assume a high voltage value (about 3.5 volts) as indicated by a broken line I in FIG. 4, whereas if there occurs a short-circuit in the $O_2$ sensor 15 itself or in the wiring, the output voltage $VO_2$ should assume nearly 0 volt, as indicated by a broken line II in the figure.

Figures 3, 3A:
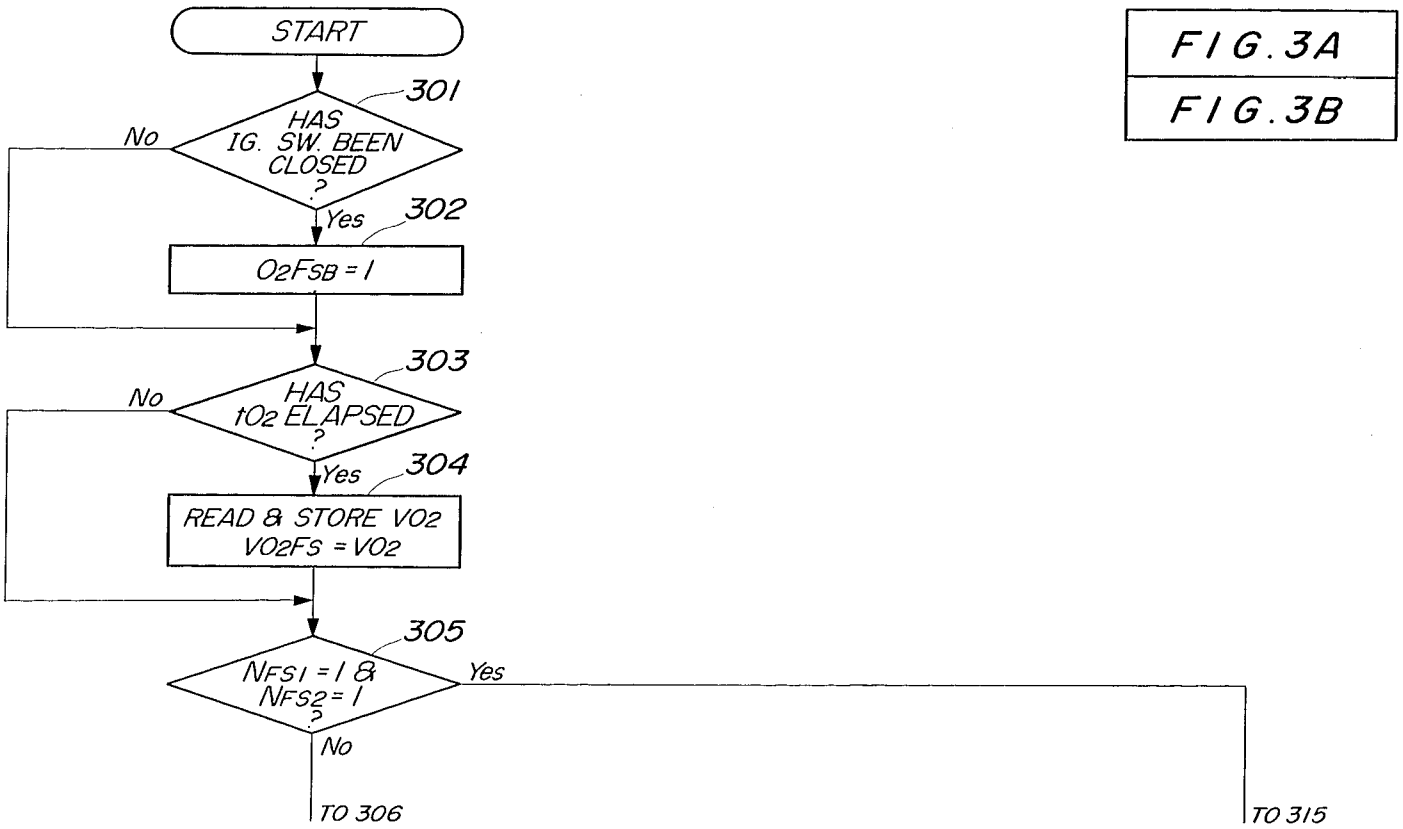
FIGS. 3, 3A and 3B are a flowchart showing a manner of detecting abnormality in an $O_2$ sensor in FIG. 2, according to the method of the invention.
Figure 3B:
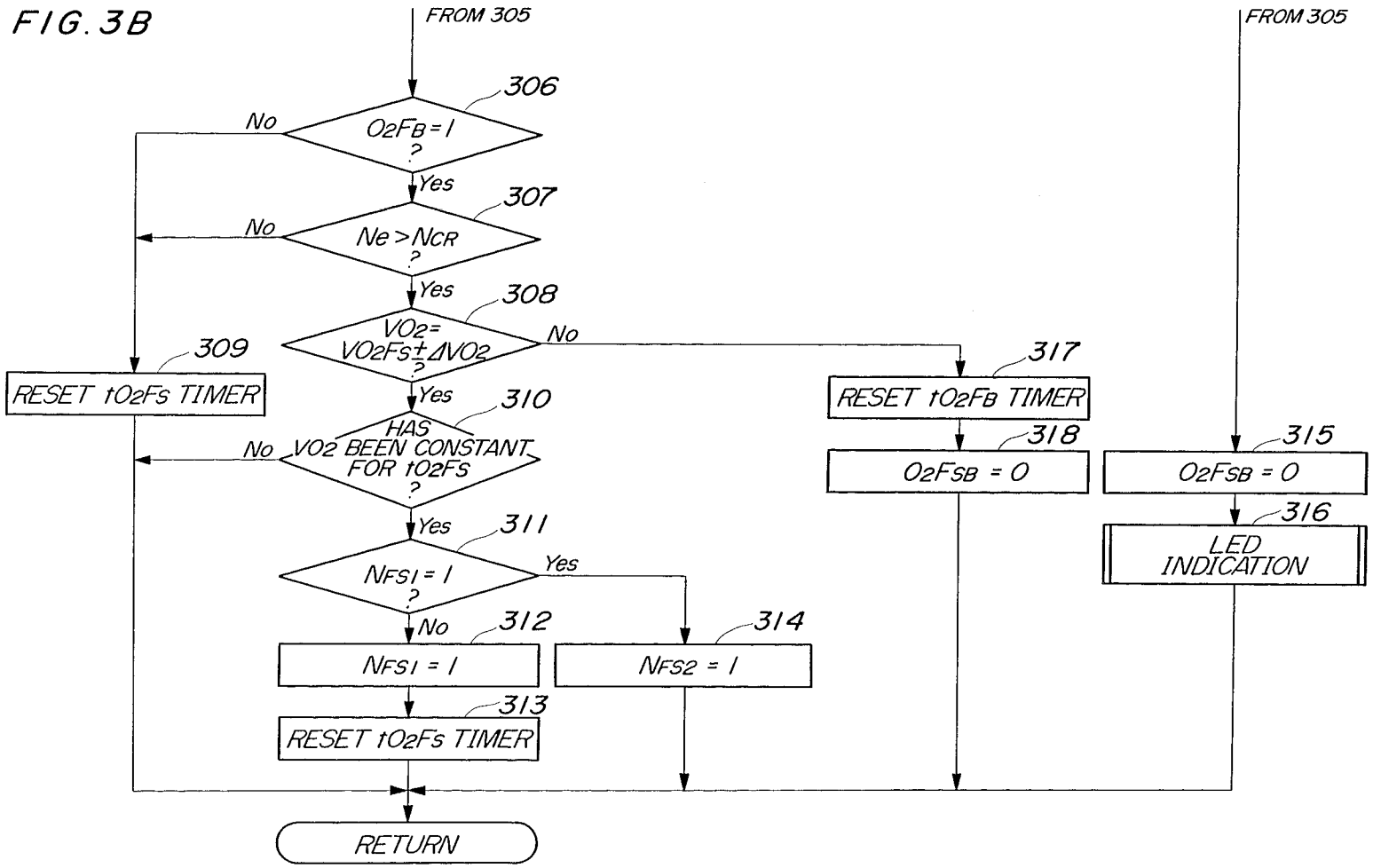

FIG. 3 is a flowchart of a program for detecting abnormality in the $O_2$ sensor and its wiring. This program is executed in synchronism with generation of each pulse of the TDC signal, by the CPU 503.

The first step 301 is for determining whether or not the ignition switch has been closed or turned from an off state to an on state. If the answer is affirmative or Yes, an abnormality-detecting flag $O_2FSB$ is set to 1 at a step 302, followed by execution of a step 303. If the answer to the question of the step 301 is negative or No, the program jumps to the step 303.

In the step 303, it is determined whether or not a predetermined period of time $tO_2$ (e.g. 5 seconds) has elapsed from the time of closing of the ignition switch. This predetermined period of time $tO_2$ is set at a value corresponding to the time lag in rise of the output voltage $VO_2$ determined by the time constant of the low pass filter in FIG. 5. If the answer to the question of the step 303 is affirmative or Yes, the output voltage $VO_2$ is read in and stored into the RAM 508 as a value $VO_2FS$ at step 304, whereas if the answer is negative or No, the program skips over the step 304 to a step 305. Preferably, the predetermined time period $tO_2$ is set at such a value that the output voltage from the $O_2$ sensor 15 once rises up to the predetermined high level (e.g. 3.5 volts) and then slightly drops therefrom to a value V1 in FIG. 4 until the predetermined time period $tO_2$ elapses if the $O_2$ sensor is functioning normally. It will therefore be noted from FIG. 4 that upon the lapse of the predetermined time period $tO_2$ the output voltage $VO_2$ or value $VO_2FS$ assumes the value V1 if the $O_2$ sensor is functioning normally, a value V1′ if a disconnection is present in the sensor or in the wiring, and a value V1″ if a short-circuit is present therein, respectively.

At the step 305, a determination is made as to whether or not first and second abnormality-determining flags NFS1 and NFS2 have both been set to 1. If the answer is negative or No, a step 306 is executed to determine whether or not the above-mentioned abnormality-detecting flag $O_2FSB$ has been set to 1 in the aforesaid step 302. If the flag $O_2FSB$ has been set to 1, a step 307 is executed to determine whether or not the engine cranking has been finished, i.e. the engine rotational speed Ne is higher than a predetermined cranking rpm value NCR above which the $O_2$ sensor abnormality detection can be accurately executed. If the former is higher than the latter, the program proceeds to the next step 308.

If the answer to either the step 306 or the step 307 is negative or No, a $tO_2FS$ timer, hereinafter referred to in reference to a step 310, is reset, at a step 309, followed by termination of the program.

The steps 308 et seq. are for checking the output voltage $VO_2$ from the $O_2$ sensor 15. It is first determined at the step 308 whether or not the output voltage $VO_2$ is substantially equal to the value $VO_2FS$ that was read in and stored in the last loop, that is, whether or not the voltage $VO_2$ is within a range of $VO_2FS$ plus minus $\Delta VO_2$. The value $\Delta VO_2$ is set at a value (e.g. 0.1 volt) smaller than the minimum possible variation in the output voltage $VO_2$ between adjacent pulses of the TDC signal, that can be assumed when the $O_2$ is functioning normally. If the answer to the question of the step 308 is affirmative or Yes, it is determined at the step 310 whether or not the answer to the step 308 has continually been affirmative or Yes until a predetermined counting period of time (e.g. 600 seconds) counted by the $tO_2FS$ timer elapses, that is, whether or not the output voltage $VO_2$ has continually been determined in the step 308 to be substantially equal to the value $VO_2FS$ for the second predetermined time period $tO_2FS$. The second predetermined period of time $tO_2FS$ is set at such a value that the sum of the first-mentioned predetermined period of time $tO_2$ and the second-mentioned predetermined period of time $tO_2FS$ is shorter than a period of time within which the $O_2$ sensor becomes completely activated after the closing of the ignition switch. The answers to the questions of steps 308 and 310 should both be affirmative or Yes if the output voltage VO2 from the $O_2$ sensor 15 remains constant as indicated by the broken line I or II in FIG. 4 over the predetermined time period $tO_2FS$, due to a disconnection or a short-circuit in the $O_2$ sensor or in the wiring.

If the answer to the step 310 is affirmative or Yes, the next step 311 is executed to determine whether or not the first abnormality-determining flag NFS1 has been set to 1. If the answer is negative or No, the flag is set to 1 at a step 312, and then the $tO_2FS$ timer is reset at a step 313, followed by termination of the program. On the other hand, if the answer to the question of the step 311 is affirmaitve or Yes, the second abnormality-determining flag NFS2 is set to 1 at a step 314, and then the program terminates. If an abnormality such as a disconnection or a short-circuit actually exists, the setting of the second flag NFS2 to 1 in the step 314 will cause the step 305 to provide an affirmative answer in the next loop, and then it will be finally decided at the step 305 that the abnormality in the $O_2$ sensor 15 actually exists. Upon the final decision of occurrence of the abnormality, the abnormality-detecting flag $O_2FSB$ is reset to 0 at a step 315, and then an LED is energized to give warning, at a step 316, followed by termination of the program.

Since a final decision is thus rendered that the $O_2$ sensor is functioning abnormally only when the two flags NFS1 and NFS2 have both been set to 1, a wrong diagnosis can be prevented that the $O_2$ sensor is functioning abnormally even when either the flag NFS1 or the flag NFS2 has erroneously been set to 1 due to noise or the like, thereby making it possible to detect abnormality without fail.

If the answer to the question of the step 310 is negative or No, the program is terminated immediately.

On the other hand, if the answer to the question of the step 308 is negative or No, that is, if the output voltage $VO_2$ from the $O_2$ sensor 15 shows changes as normally assumed by the sensor during normal functioning after completion of the rise in the voltage $VO_2$ with the lapse of the predetermined time period $tO_2$ following the closing of the ignition switch (as indicated by the solid line in FIG. 4), it is decided that the $O_2$ sensor 15 is functioning normally, and then the $tO_2FS$ timer is reset at a step 317 and the abnormality-detecting flag $O_2FSB$ is reset to 0 at a step 318, followed by termination of the program.

It will be learned from the foregoing description that the method of the invention can be carried out for abnormality detection before the activation of the $O_2$ sensor 15 is completed, i.e. before the time point T in FIG. 4 is reached after the start of the engine. Therefore, the time period before detection of $O_2$ sensor abnormality after the start of the engine can be greatly shortened as compared with the prior art methods, thereby making it possible to avoid incorrect air-fuel ratio control and accordingly degraded exhaust emissions from the engine.

What is claimed is:

1. A method of detecting abnormality in an exhaust gas concentration sensor for detecting the concentration of a component in exhaust gases from an internal combustion engine equipped with a fuel supply control system which controls a quantity of fuel to be supplied to said engine in a feedback manner responsive to a value of an air-fuel ratio correction value set in response to an output signal from said exhaust gas concentration sensor which output signal first rises to a higher level than a level of the output signal which said exhaust gas concentration sensor assumes operating normally after activation thereof, upon starting of said engine, and then gradually decreases with a lapse of time toward said level of the output signal assumed after activation thereof if said exhaust gas concentration sensor is operating normally, the method comprising the steps of;

(a) starting to monitor said output signal from said exhaust gas concentration sensor from the time a first predetermined period of time, which lasts from a moment at which said engine is started to a moment at which said output signal from said exhaust gas concentration sensor begins to gradually decrease if said exhaust gas concentration sensor is operating normally, has elapsed from the start of said engine;

(b) determining whether or not said output signal has continually maintained a substantially constant value for a second predetermined period of time elapsed following said first predetermined period of time, said second predetermined period of time being set at such a value that the sum of said first predetermined period of time and said second predetermined period of time is shorter than a period of time within which said exhaust gas concentration sensor becomes completely activated after the start of said engine; and (c) rendering a decision that said exhaust gas concentration sensor is functioning abnormally if said output signal has continually maintained a substantially constant value over said second predetermined period of time.

2. A method as claimed in claim 1, wherein said first predetermined period of time is set at a value corresponding to a time lag in rise of said output signal from said exhaust gas concentration sensor.

3. A method of detecting abnormality in an exhaust gas concentration sensor for detecting the concentration of a component in exhaust gases from an internal combustion engine equipped with a fuel supply control system which controls a quantity of fuel to be supplied to said engine in a feedback manner responsive to a value of an air-fuel ratio correction value set in response to an output signal from said exhaust gas concentration sensor which output signal first rises to a higher level than a level of the output signal which said exhaust gas concentration sensor assumes operating normally after activation thereof, upon starting of said engine, and then gradually decreases with the lapse of time toward said level of the output signal assumed after activation thereof, if said exhaust gas concentration sensor is normally operating, the method comprising the steps of:

(a) starting to read and store a value of said output signal from said exhaust gas concentration sensor when a first predetermined period of time, which lasts from a moment at which said engine is started to a moment at which said output signal from said exhaust gas concentration sensor beings to gradually decrease if said exhaust gas concentration sensor is operating normally, has elapsed from the start of said engine;

(b) reading and storing subsequent values of said output signal from said exhaust gas concentration sensor until a second predetermined period of time elapses from the time said first predetermined period of time has elapsed, each time a pulse of a predetermined control signal is generated, said second predetermined period of time being set at such a value that the sum of said first predetermined period of time and said second predetermined period of time is shorter than a period of time within which said exhaust gas concentration sensor becomes completely activated after the start of said engine;

(c) comparing a first value of said output signal read at the time of a present pulse of said predetermined control signal with a second value of said output signal read and stored at the time of an immediately preceding pulse of said predetermined control signal to determine whether or not the first value is substantially equal to the second value; and (d) rendering a decision that said exhaust gas concentration sensor is functioning abnormally if said first value has continually remained substantially equal to said second value over said second predetermined period of time.

4. A method as claimed in claim 3, wherein said first predetermined period of time is set at a value corresponding to a time lag in rise of said output signal from said exhaust gas concentration sensor.

5. A method as claimed in claim 3, wherein pulses of said predetermined control signal are generated at predetermined crank angles of said engine.

6. A method as claimed in claim 5, wherein said step (c) includes determining whether or not said first value of said output signal from said exhaust gas concentration sensor differs from said second value by a predetermined amount smaller than the minimum possible variation in said output signal that can be assumed by said exhaust gas concentration sensor between said present pulse of said predetermined control signal and said immediately preceding pulse thereof if said sensor is functioning normally.

7. A method of detecting abnormality in an exhaust gas concentration sensor for detecting the concentration of a component in exhaust gases from an internal combustion engine equipped with a fuel supply control system which controls a quantity of fuel to be supplied to said engine in a feedback manner responsive to a value of an air-fuel ratio correction value set in response to an output signal from said exhaust gas concentration sensor, said output signal first rising to a higher level than a level of the output signal which said exhaust gas concentration sensor assumes operating normally after activation thereof, and then gradually decreasing from said higher level toward said level of the output signal assumed after the activation thereof, with the lapse of time, if said exhaust gas concentration sensor is operating normally, the method comprising the steps of:

(a) monitoring said output signal from said exhaust gas concentration sensor from the time said output signal from said exhaust gas concentration sensor is to begin to gradually decrease from said higher level toward said level of the output signal assumed after activation thereof, if said exhaust gas concentration sensor is operating normally, after the start of said engine, (b) determining whether or not said output signal has continually remained a substantially constant value for a predetermined period of time while said output signal from said exhaust gas concentration sensor should have decreased gradually from said higher level toward said level of the output signal assumed after activation thereof if the exhaust gas concentration sensor was operating normally; and (c) rendering a decision that said exhaust gas concentration sensor is functioning abnormally if said output signal has continually remained a substantially constant value over said predetermined period of time.

* * * * *